US007135663B2

(12) United States Patent
Kang

(10) Patent No.: US 7,135,663 B2
(45) Date of Patent: Nov. 14, 2006

(54) WALL MOUNTED TYPE MICROWAVE OVEN

(75) Inventor: Jeon Hong Kang, Yongin-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 128 days.

(21) Appl. No.: 10/864,341

(22) Filed: Jun. 10, 2004

(65) Prior Publication Data

US 2005/0121445 A1 Jun. 9, 2005

(30) Foreign Application Priority Data

Dec. 3, 2003 (KR) ..... 10-2003-0087204

(51) Int. Cl.
*H05B 6/80* (2006.01)

(52) U.S. Cl. ..... 219/757; 219/681; 126/21 A; 126/299 R

(58) Field of Classification Search ..... 219/757, 219/681, 678–763; 126/21 A, 299 R, 299 D
See application file for complete search history.

(56) References Cited

U.S. PATENT DOCUMENTS 5,801,362 A * 9/1998 Pearlman et al. ..... 219/400
6,707,019 B1 * 3/2004 Kim ..... 219/757
2003/0218011 A1 * 11/2003 Jeong ..... 219/757

FOREIGN PATENT DOCUMENTS

JP 2000161671 A * 6/2000
KR 2003-49322 6/2003

* cited by examiner

*Primary Examiner*—Quang Van
(74) *Attorney, Agent, or Firm*—Staas & Halsey LLP

(57) ABSTRACT

A wall mounted type microwave oven including an improved exhaust and cooling unit to allow a direction of an outlet of an exhaust fan casing or a cooling fan casing to change while retaining or reducing an original size thereof. The exhaust and cooling unit includes an exhaust fan and a cooling fan, a driving motor to rotate the fans, the casings to house the respective fans, axes of the casings being eccentric to axes of the respective fans, and first and second brackets to hold the casings fixed to the respective fans, the axes of the brackets substantially coinciding with axes of the respective fans. A length between the axis of the cooling fan and a maximum radius region of the cooling fan casing is equal to or smaller than a half of a length of a side of the second bracket.

12 Claims, 9 Drawing Sheets

WALL MOUNTED TYPE MICROWAVE OVEN

CROSS-REFERENCE TO RELATED APPLICATION

This application claims the benefit of Korean Patent Application No. 2003-87204, filed Dec. 3, 2003 in the Korean Intellectual Property Office, the disclosure of which is incorporated herein by reference.

BACKGROUND OF THE INVENTION

1. Field of the Invention

The present invention relates a wall mounted type microwave oven, and more particularly, to a wall mounted type microwave oven including an improved exhaust and cooling unit, which allows a direction of an outlet of an exhaust fan casing or an cooling fan casing to be changed to another direction while retaining an original size or reducing the original size thereof.

2. Description of the Related Art

A conventional wall mounted type microwave oven is generally installed above an oven range is typically placed on kitchen appliances in a kitchen, and serves to perform an operation of exhausting, for example, exhaust air, smoke and food odors, which are generated from other cooking apparatuses, to an outside of the kitchen, as well as an operation of cooking food by high frequency electromagnetic waves in a typical microwave oven.

The wall mounted type microwave oven includes an oven cabinet forming an external appearance thereof as in a typical microwave oven, and is provided with a cooking chamber to cook foods therein and an electrical component compartment to house various electrical components, the cooking chamber and the electrical component compartment being isolated from each other by a partition plate. The wall mounted type microwave oven further includes an exhaust path defined between the cooking chamber and the oven cabinet, and an exhausting unit positioned at an upper portion of the exhaust path, so as to draw exhaust gas and the food odors generated from the other cooking apparatuses installed below the oven cabinet through the exhaust path and discharge the exhaust gas and the food odors to the outside of the kitchen.

The exhausting unit includes a driving motor, a pair of exhaust fans coupled to opposite ends of the driving motor, each of the exhaust fans having a common size, and a pair of casing surrounding the exhaust fans. Thus, according to the conventional exhausting unit, the pair of exhaust fans is rotated by a single driving motor to perform an exhausting operation.

Among the two sets of exhaust fans and respective casings, one set of the exhaust fan and the casing may be configured to cool the various electrical components installed in the electrical component compartment.

In this case, each of the exhaust fan casing and of the cooling fan casing is configured such that an axis of each of the fan casing (i.e., the exhaust fan casing and the cooling fan casing) is positioned to be eccentric to an axis of the corresponding fan, so as to draw the exhaust gas into the corresponding fan and to be discharged therefrom. That is, on a circumference of each of the fan casings, a major radius region, which corresponds to the maximum radius between the axis of the fan and the circumference of the fan casing, and a minor radius region, which corresponds to the minimum radius between the axis of the fan and the circumference of the fan casing, are present.

The exhaust fan casing is configured such that an outlet of the exhaust fan casing is selectively directable to any one of an upside direction, a rear direction and a front direction of the exhaust fan casing, depending on conditions of a location at which a wall mounted type microwave oven is installed, so as to allow the exhaust gas to be efficiently discharged to the outside of the kitchen. The cooling fan casing is configured such that an outlet of the cooling fan casing must be always directed toward only an electrical component compartment.

The conventional wall mounted type microwave oven includes an exhaust fan casing and a cooling fan casing which have a common size. Accordingly, when changing a direction of the outlet of the exhaust fan casing to another direction is necessary, either the exhaust fan casing or the cooling fan casing is rotated after being dismounted from the microwave oven and is remounted on the microwave oven in a state of the outlet of the fan casing being directed to a desired direction. Since the major radius region of the respective fan casing is rotated with respect to a fixed axis of the corresponding fan, by a change of a direction of the outlet of the respective fan casing, a part of the circumference of the respective fan casing corresponding to the major radius region protrudes in another direction.

Accordingly, to change the direction of the outlet of the exhaust fan casing, the wall mounted type microwave oven must have an additional space to accommodate a protrusion of one of the exhaust fan casing and the cooling fan casing due to the change of a position of the respective fan casing. Consequently, a volume of the cooking chamber to cook the food therein must be reduced, or a volume of the oven cabinet must be increased.

SUMMARY OF THE INVENTION

Accordingly, it is an aspect of the present invention to provide a wall mounted type microwave oven including an improved exhaust and cooling unit, which allows a direction of an outlet of an exhaust fan casing or a cooling fan casing to change while retaining an original size thereof or reducing the original size thereof.

Additional aspects and/or advantages of the invention will be set forth in part in the description which follows and, in part, will be obvious from the description, or may be learned by practice of the invention.

The above and/or other aspects are achieved by providing a wall mounted type microwave oven including an oven cabinet with an exhaust path disposed at a side of the oven cabinet, a cooking chamber and an electrical component compartment formed in the oven cabinet to be isolated from each other, and an exhaust and cooling unit disposed at an upper portion of the oven cabinet. The exhaust and cooling unit includes an exhaust fan to discharge exhaust gas introduced into the exhaust path, a cooling fan to blow air into the electrical component compartment, which has a diameter smaller than that of the exhaust fan, and a driving motor coupled to the exhaust fan and the cooling fan at opposite ends thereof to rotate the exhaust fan and the cooling fan.

The exhaust and cooling unit may further include an exhaust fan casing to house the exhaust fan, a cooling fan casing to house the cooling fan, and first and second brackets disposed at opposite ends of the driving motor to hold the exhaust fan casing and the cooling fan casing fixed to the first and second brackets, respectively.

An axis of the cooling fan casing may substantially coincide with an axis of the second bracket and may be eccentric to an axis of the cooling fan, and the cooling fan casing may have a diameter smaller than a diameter of the exhaust fan casing.

A length between the axis of the second bracket and a maximum radius region of the cooling fan casing may be equal to or smaller than a length between the axis of the second bracket and a point on a side of the second bracket at which a line connected between the axis and the side of the second bracket is perpendicular to the side.

The cooling fan casing may include a pair of lugs, each having a screw hole, which are diagonally positioned with respect to the second bracket to be diametrically opposed to each other and fixed to the second bracket by screws.

An outlet of the cooling fan casing may be positioned to face the electrical component compartment, and the outlet of the exhaust fan casing may be positioned to face upward, rearward or forward of the oven cabinet, depending on installing conditions of the microwave oven.

A direction of the outlet of the cooling fan casing may be changed such that the cooling fan casing rotates by 90 degrees with respect to the second bracket.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE PREFERRED EMBODIMENT

Figure 1:
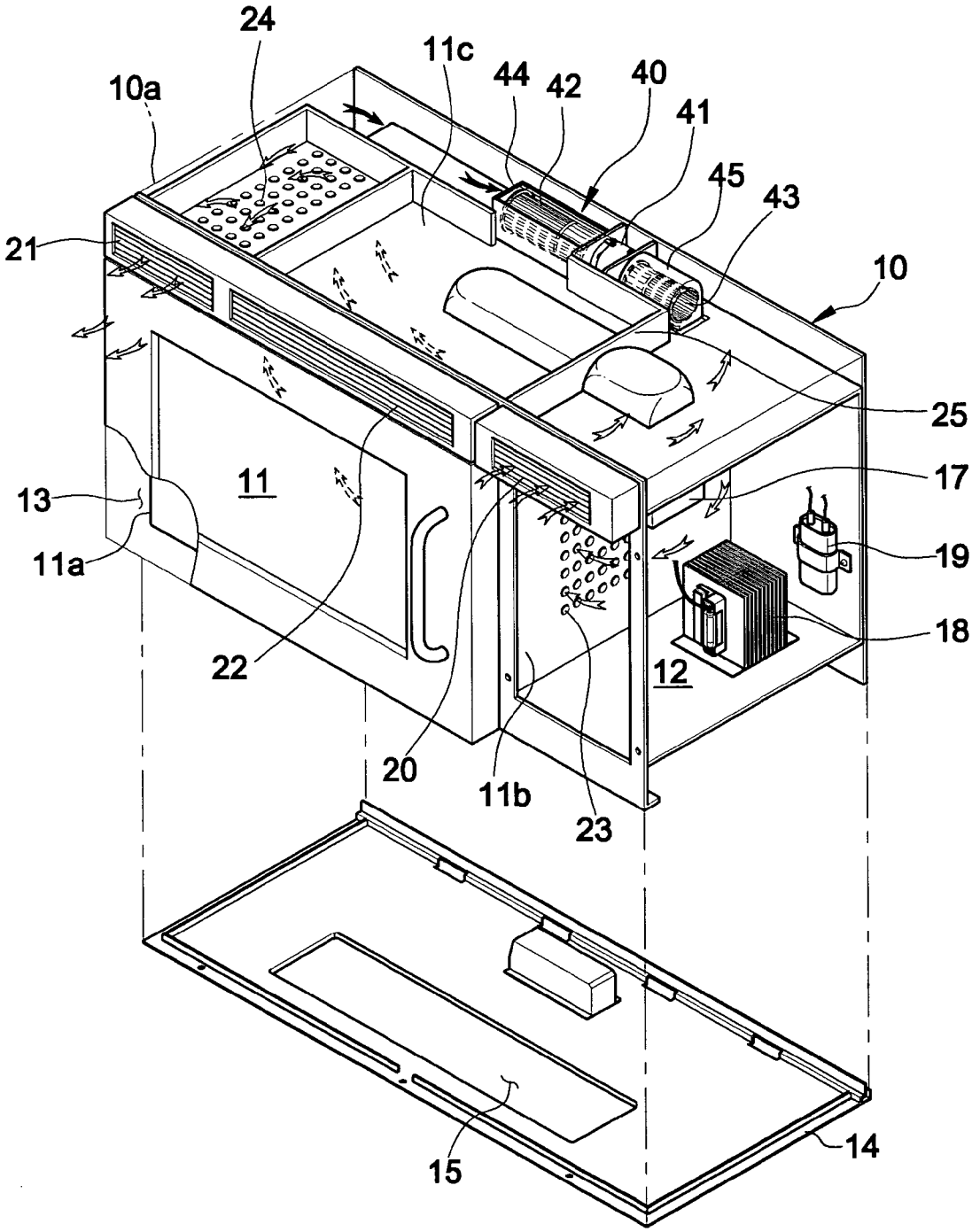
FIG. 1 is a perspective view of a wall mounted type microwave oven according to an embodiment of the present invention.

Reference will now be made in detail to the embodiment of the present invention, examples of which are illustrated in the accompanying drawings, wherein like reference numerals refer to like elements throughout. The embodiment is described below to explain the present invention by referring to the FIGS.

FIG. 1 is a perspective view of a wall mounted type microwave oven according to an embodiment of the present invention, which shows flows of exhaust gas and cooling air. As shown in FIG. 1, the wall mounted type microwave oven includes a box-shaped oven cabinet 10, and a cooking chamber 11 and an electrical component compartment 12 which are provided in the oven cabinet 10 to be separated from each other by a right plate 11 of the cooking chamber 11.

The box-shaped oven cabinet 10 is provided at a lower face thereof with a hood 14 having an intake opening 15, so that, for example, exhaust gas and smoke generated from other cooking apparatuses such as a gas oven range (not shown) from a cooking operation thereof are introduced into the box-shaped oven cabinet 10 through the intake opening 15. An exhaust path 13 is provided between a left panel 10*a* of the box-shaped oven cabinet 10 and a left plate 11*a* of the cooking chamber 11, so as to allow the exhaust gas introduced through the intake opening 15 of the hood 14 to be directly exhausted to an outside of a room, or to be filtered and then discharged to the room.

An air inlet 20, an air outlet 21 and an exhaust outlet 22 are provided at front and upper portions of the electrical component compartment 12 and the cooking chamber 11. A right plate 11*b*, which isolates the cooking chamber 11 from the electrical component compartment 12, includes a plurality of through-holes 23, and a top plate 11*c* of the cooking chamber 11 includes a plurality of through-holes 24.

The top plate 11*c* of the cooking chamber 11, which serves as a common ceiling of the cooking chamber 11 and the electrical component compartment 12, is provided with a duct unit 25 thereon. An exhaust and cooling unit 40 is disposed in a rear of the duct unit 25, which operates to draw and discharge exhaust gas as well as to blow air toward the electrical component compartment 12 and the cooking chamber 11.

Figure 2:
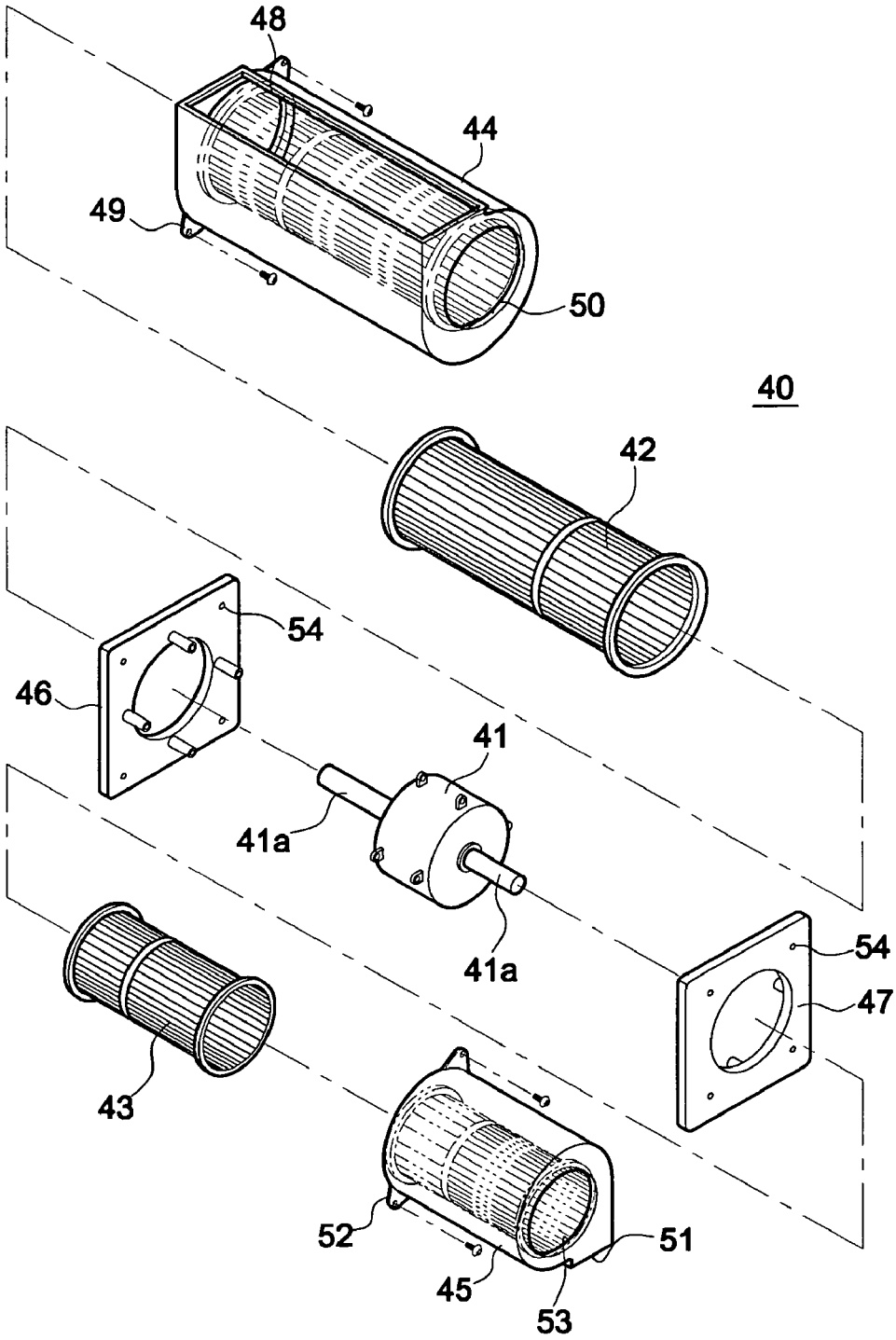
FIG. 2 is an exploded perspective view of an exhaust and cooling unit of the wall mounted type microwave of FIG. 1.

The exhaust and cooling unit 40 includes a driving motor 41, an exhaust fan 42 and a cooling fan 43 coupled to opposite ends of the driving motor 41, and rotated by the driving motor 41, an exhaust fan casing 44 and a cooling fan casing 45 to house the exhaust fan 42 and the cooling fan 43, respectively, and first and second brackets 46 and 47 to hold the exhaust fan casing 44 and the cooling fan casing 45, respectively (see FIG. 2). A structure of the exhaust and cooling unit 40 will be described later with reference to FIG. 2.

The exhaust fan 42 and the exhaust fan casing 44 communicate with the exhaust path 13 to discharge the exhaust gas, and the cooling fan 43 and the cooling fan casing 45 communicate with the air inlet 20 positioned on the electrical component compartment 12 to cool electrical components such as a magnetron 17, a high voltage transformer 18 and a condenser 19.

Accordingly, when the driving motor 41 is operated to, for example, discharge the exhaust gas, the exhaust gas and the smoke are introduced into the exhaust path 13 through the intake opening 15 of the hood 14, and then discharged from the box-shaped oven cabinet 10 in a rearward direction, in an upward direction or in a forward direction of the box-shaped oven cabinet 10, depending on an orientation of the exhaust fan casing 44. For example, the exhaust outlet 22 is provided an upper, center portion of a front of the box shaped oven cabinet 10 to discharge the exhaust gas and the smoke introduced into the exhaust path when the exhaust fan casing 44 is oriented to blow the exhaust gas and the smoke in the forward direction When food is cooked in the cooking chamber 11, air is introduced into the electrical component compartment 12 through the air inlet 20 by a suction force of the cooling fan 43, where the air cools the electrical components such as the magnetron 17. Subsequently, the air in the electrical component compartment 12 is introduced into the cooking chamber 11 through the through-holes 23 to eliminate moisture and food odors in the cooking chamber 11, and is discharged to the room through the through-holes 24 and the air outlet 21.

Figure 3:
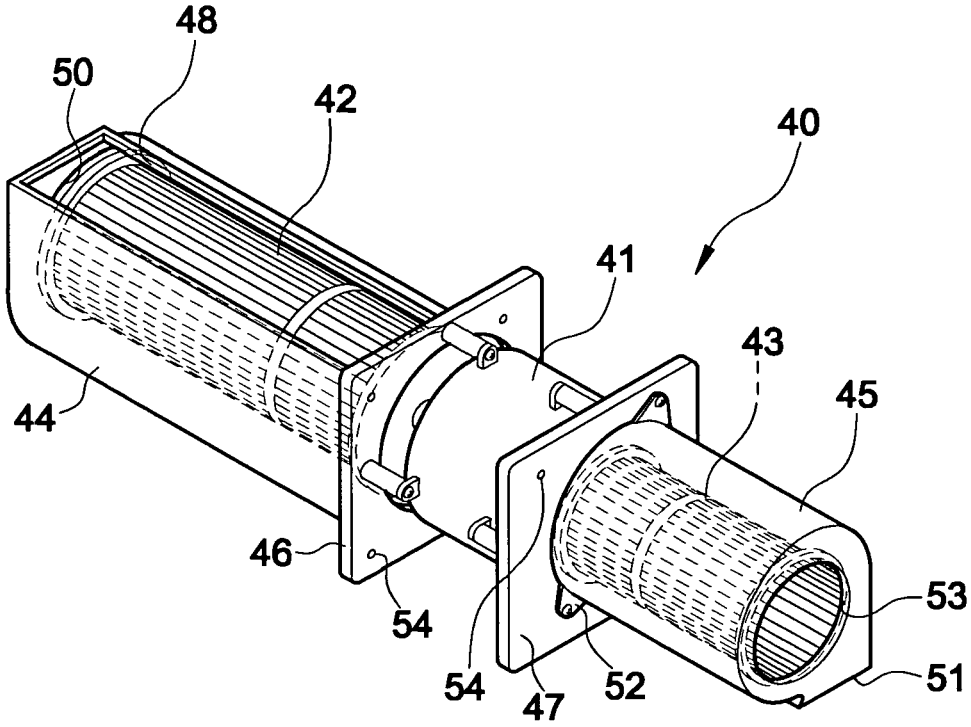
FIG. 3 is a perspective view of the exhaust and cooling unit of FIG. 2, in which an outlet of an exhaust fan casing is positioned to face upward while an outlet of a cooling fan casing is positioned to face downward.

FIG. 2 is an exploded perspective view of the exhaust and cooling unit and FIG. 3 is a perspective view of the exhaust and cooling unit of FIG. 2, which is assembled. As shown in FIGS. 2 and 3, the exhaust and cooling unit 40 includes the driving motor 41, the exhaust fan 42, the exhaust fan casing 44, the cooling fan 43, the cooling fan casing 45, and the first and second brackets 46 and 47.

The driving motor 41 is fixed to the first and second brackets 46 and 47 at opposite ends thereof by screws. The exhaust fan 42 and the cooling fan 43, each of which includes a plurality of blades radially arranged as, for example, in a Sirocco fan, are coupled to rotating shafts 41*a*, respectively, projected from opposite ends of the driving motor 41.

The exhaust fan casing 44, which receives the exhaust fan 42 and provides a space to compress and to discharge air by a centrifugal force of the rotating exhaust fan 42, is constructed to have an approximate cylindrical shape with opposite ends opened. The exhaust fan casing 44 includes an outlet 48 at a circumferential surface thereof to allow air to discharge therethrough.

The exhaust fan casing 44 includes a pair of lugs 49, each of which protrudes from an opened end (or a fixing end) of the exhaust fan casing 44 and has corresponding screw holes. The first bracket 46 includes a plurality of threaded holes 54 corresponding to the screw holes of the exhaust fan casing 44. Accordingly, the exhaust fan casing 44 is fixed to the first bracket 46 by tightening screws into the threaded holes 54 of the first bracket 46 through the screw holes of the exhaust fan casing 44. Another end (or a free end) of the exhaust fan casing 44 is provided with an inlet 50 to allow air to be drawn into the exhaust fan casing 44 therethrough.

Similar to the exhaust fan casing 44, the cooling fan casing 45, which receives the cooling fan 43 and provides a space to compress and to discharge air by a centrifugal force of the cooling fan 43, is constructed to have an approximately cylindrical shape with opposite ends opened. The cooling fan casing 45 includes an outlet 51 at a circumferential surface thereof to allow the air to discharge therethrough.

The cooling fan casing 45 includes a pair of lugs 52, each of which protrudes from an opened end (or a fixing end) of the cooling fan casing 45 and has corresponding screw holes. The second bracket 47 includes a plurality of threaded holes 54 corresponding to the screw holes of the cooling fan casing 45. Accordingly, the cooling fan casing 45 is fixed to the second bracket 47 by tightening screws into the threaded holes 54 of the second bracket 47 through the screw holes of the cooling fan casing 45. Another end (or a free end) of the cooling fan casing 45 is provided with an inlet 53 to allow the air to be drawn into the cooling fan casing 45 therethrough.

The pair of lugs 52 of the cooling fan casing 45 is diagonally positioned to be diametrically opposed to each other. The second bracket 47 is provided with threaded holes 54 at corners thereof to correspond to the screw holes of the lugs 52. Accordingly, when the cooling fan casing 45 is fixed to the second bracket 47, the lugs 52 of the cooling fan casing 45 are positioned at the corners of the second bracket 47.

The cooling fan 43 and the cooling fan casing 45 have diameters smaller than those of the exhaust fan 42 and the exhaust fan casing 44, respectively. The exhaust fan 42 and the cooling fan 43, which are coaxially coupled to the rotating shafts 41*a*, respectively, of the driving motor 41, are installed such that axes "C" of the exhaust fan 42 and the cooling fan 43 are aligned with centers of the first and second brackets 46 and 47 (see FIG. 4).

Figure 4:
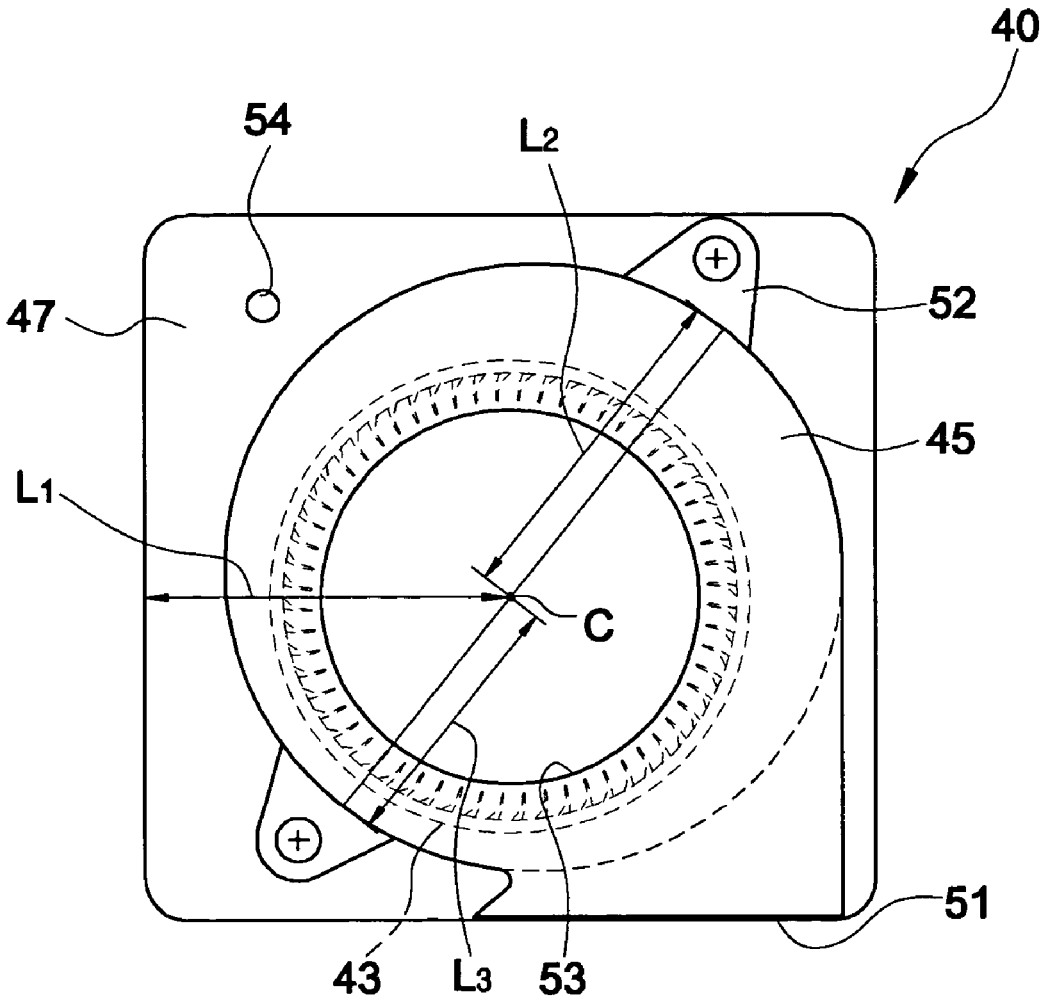
FIG. 4 is a side view of the exhaust and cooling unit of FIG. 3.

The exhaust fan casing 44 and the cooling fan casing 45 are installed such that axes of the exhaust fan casing 44 and the cooling fan casing 45 are eccentric to the axes "C" of the exhaust fan 42 and the cooling fan 43 so as to compress and to discharge the air by centrifugal force of the exhaust fan 42 and the cooling fan 43 (see FIG. 4).

The first bracket 46 is shaped into an approximately square form such that a length of a side of the first bracket 46 is nearly equal to a diameter of the exhaust fan casing 44, which is positioned to be eccentric to the axis of the exhaust fan 42. Therefore, by removing only the cooling fan casing 45 from the second bracket 47 and changing an orientation of the cooling fan casing 45, a direction of the outlet 48 of the exhaust fan casing 44 is simply changeable.

The second bracket 47 has a common shape and size as those of the first bracket 46. Accordingly, the cooling fan casing 45, which is smaller than that of the exhaust fan casing 44 and positioned to be eccentric to the axis of the cooling fan 43, is changeable in an orientation thereof within an area of the second bracket 47.

Although the first and second brackets 46 and 47 are described to be square in shape, the first and second brackets 46 and 47 are not limited to the square shape and may be shaped into other forms.

Figure 5:
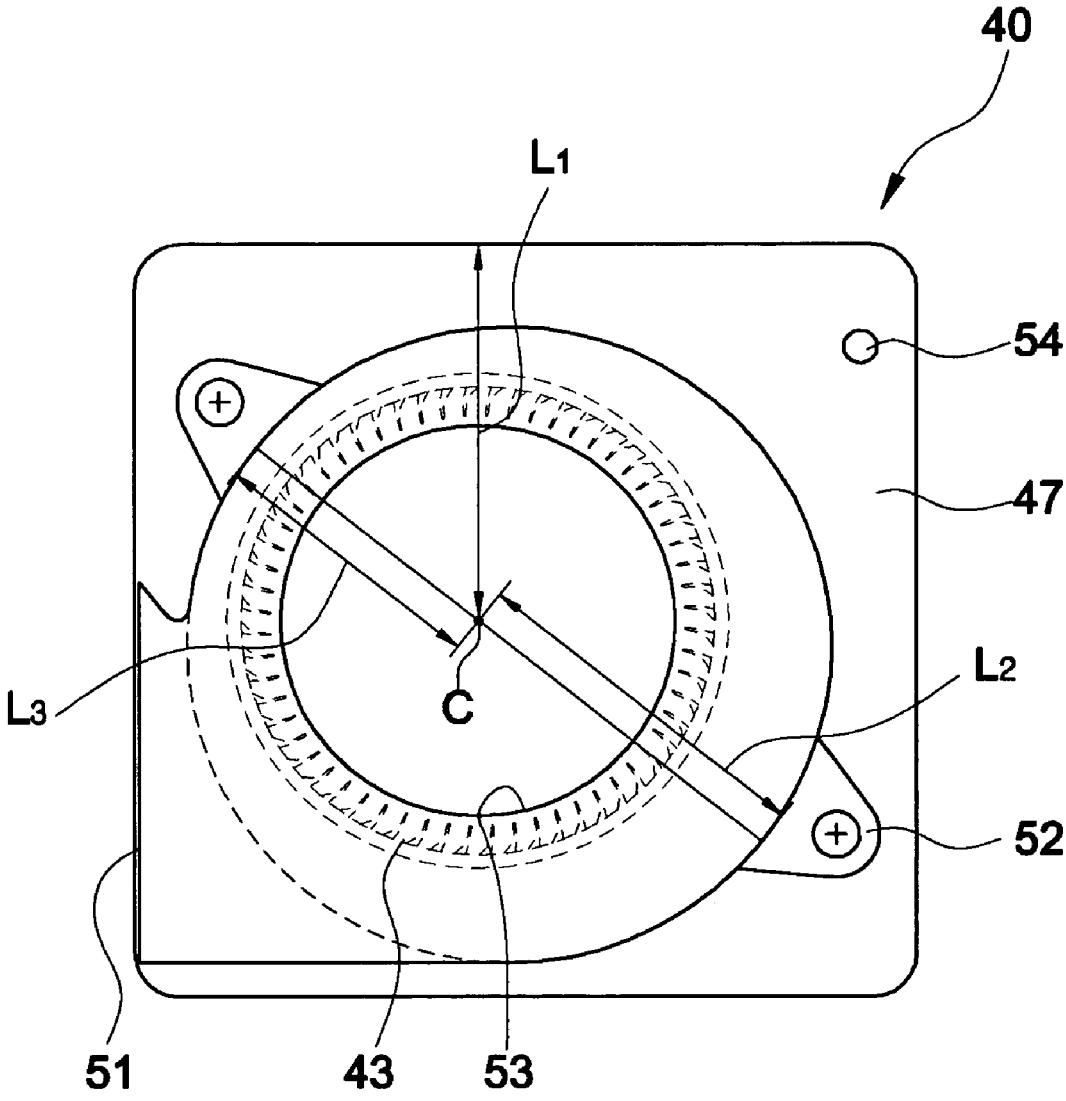
FIG. 5 is a side view of the exhaust and cooling unit of FIG. 3, in which the outlet of the cooling fan casing rotates by 90 degrees from a position shown in FIG. 4.

FIGS. 4 and 5 show the cooling fan casing 45 which is changed in a direction of the outlet 51 thereof. As shown in FIGS. 4 and 5, the cooling fan casing 45 is positioned such that the outlet 51 of the cooling fan casing 45 faces downward. In this state, since the axis of the cooling fan casing 45 is positioned to be eccentric to the axis "C" of the cooling fan 43 or the axis of the second bracket 47, air is drawn into the inlet 53 of the cooling fan casing 45 and then is discharged through the outlet 51 by a rotation of the cooling fan 43.

Thus, the cooling fan casing 45 includes a major radius region, which is located at a farthest point from the axis "C" of the second bracket 47, and a minor radius region which is located at a closest point from the axis "C" of the second bracket 47. An eccentric length of the cooling fan casing 45 is equal to a difference between a maximum radius L2, which is a length between the axis "C" of the second bracket 47, and the major radius region, and a minimum radius L3 which is a length between the axis "C" of the second bracket 47 and the minor radius region.

The cooling fan casing 45 may be flexible in an orientation thereof within an area of the second bracket 47, so as not to protrude beyond the area of second bracket 47. The maximum radius L2, which is a length between the axis "C" of the second bracket 47 and the major radius region of the cooling fan casing 45, may not be larger than a length L1, which is a length between the axis "C" and a point on each of sides of the second bracket 47 at which a line connected between the axis "C" and the side of the second bracket 47 is perpendicular to a respective one of the sides. That is, the length L2 may not be larger than a half of a length of each of the sides of the second bracket 47.

By the above configuration of the exhaust and cooling unit, even when the cooling fan casing 45 rotates clockwise by an angle of 90 degrees from a position shown in FIG. 4, as shown in FIG. 5, the major radius region of the cooling fan casing 45 does not protrude from the second bracket 47.

An operation of changing a position of the cooling fan casing 45 with respect to the second bracket 47 to cover a direction of the outlet 48 of the exhaust fan casing 44 will now be described with reference to FIGS. 6 through 9.

Figure 6:
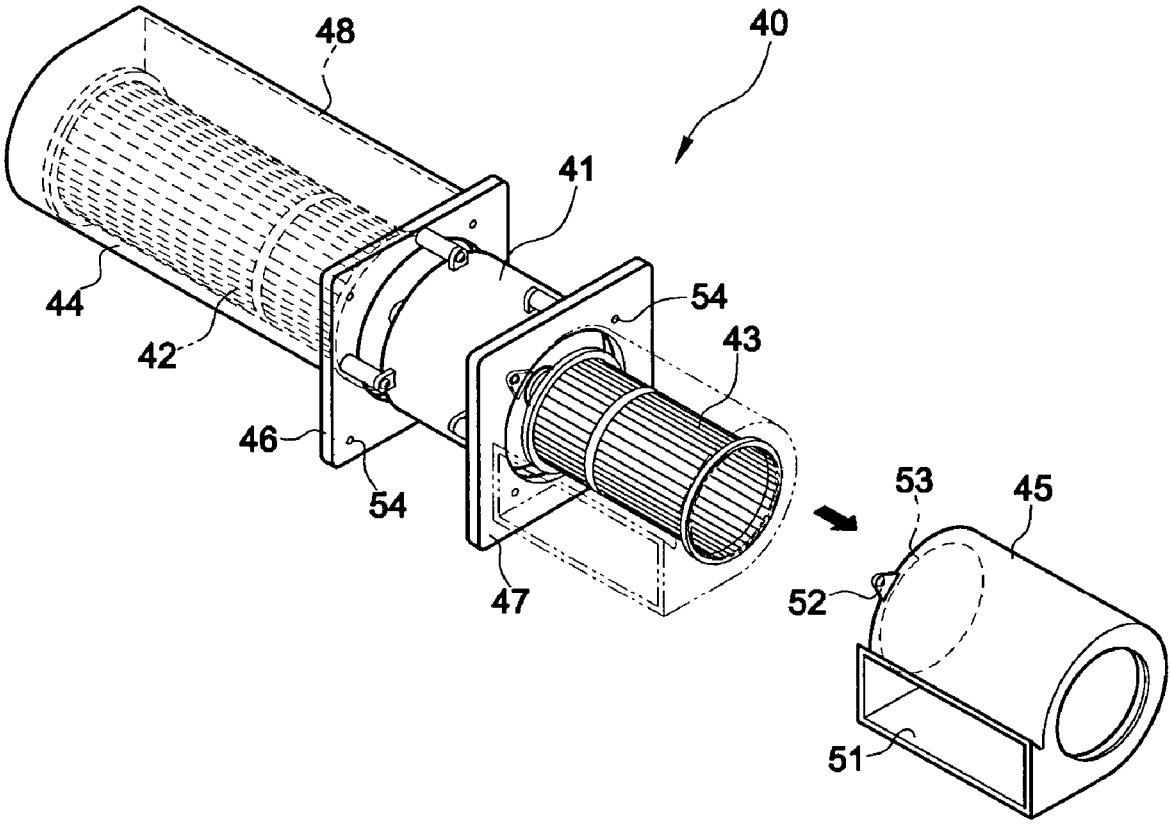
FIGS. 6 and 7 are perspective views showing an operation of directing the outlet of the cooling fan casing downward while directing the outlet of the exhaust fan casing rearward.
Figure 7:
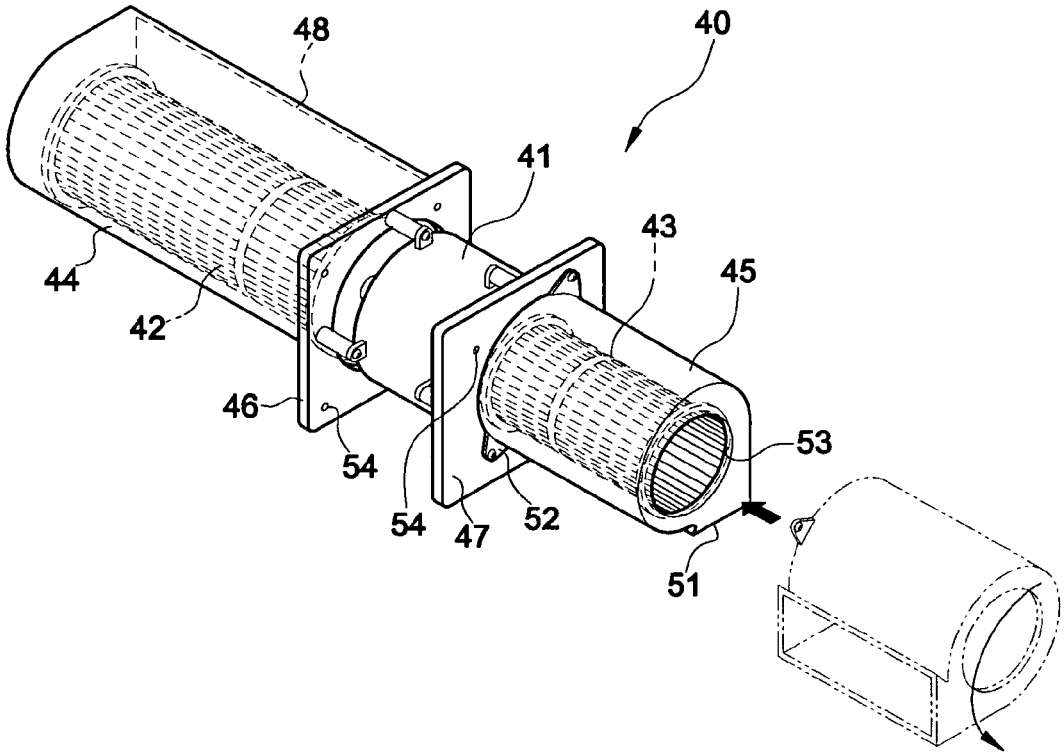

FIGS. 6 and 7 show an operation of directing the outlet 51 of the cooling fan casing 45 in a downward direction while directing the outlet 48 of the exhaust fan casing 44 in a rearward direction.

To change a posture of the exhaust fan casing 44 to a position in which the outlet 48 of the exhaust fan casing 44 faces in an upward direction (see FIG. 3) from a position in which the outlet 48 of the exhaust fan casing 44 faces in the rearward direction, the exhaust and cooling unit 40 is first rotated clockwise by an angle of 90 degrees, and the cooling fan casing 45 is removed from the second bracket 47, as shown in FIG. 6.

Subsequently, the cooling fan casing 45 rotates counter-clockwise by an angle of 90 degrees, and mounted on the second bracket 47 by screws, as shown in FIG. 7. As a result, the outlet 51 of the cooling fan casing 45 is directed downward while the outlet 48 of the exhaust fan casing 44 remains to be directed in the rearward direction. Accordingly, the exhaust fan 42 is dischargeable exhaust gas in the rearward direction, and the cooling fan casing 45 may direct air into the electrical component compartment 12.

Figure 8:
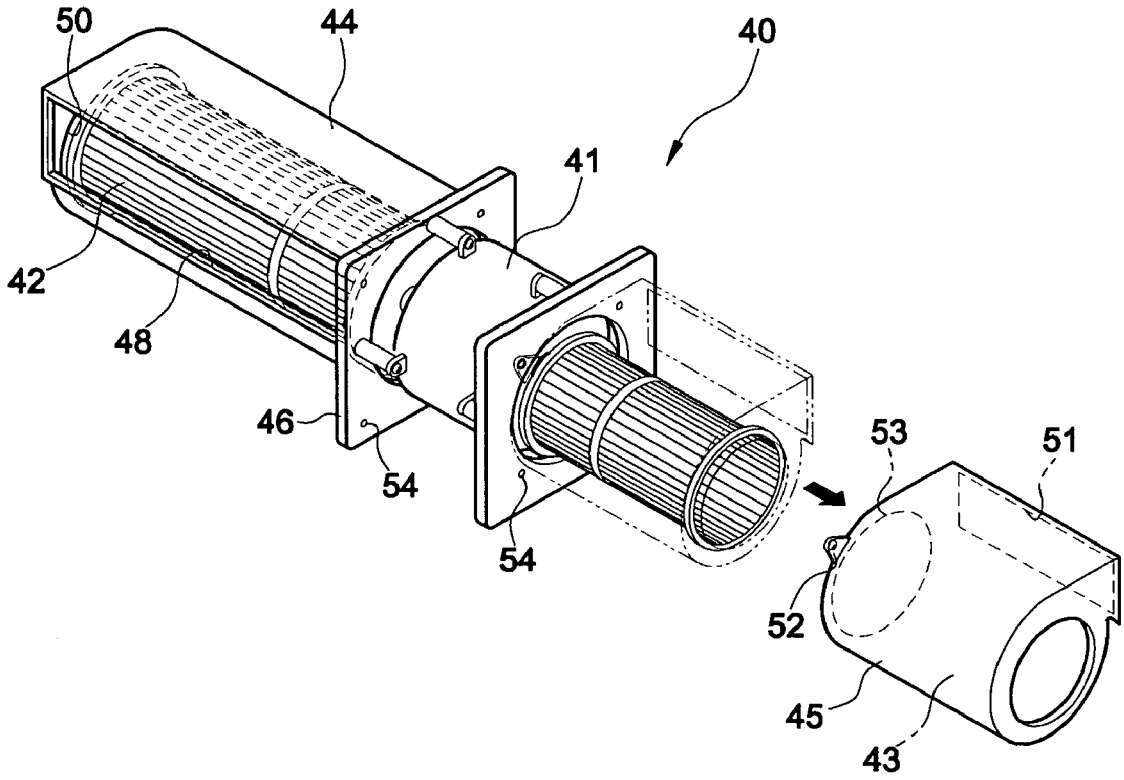
FIGS. 8 and 9 are perspective views showing an operation of directing the outlet of the cooling fan casing downward while directing the outlet of the exhaust fan casing forward.
Figure 9:
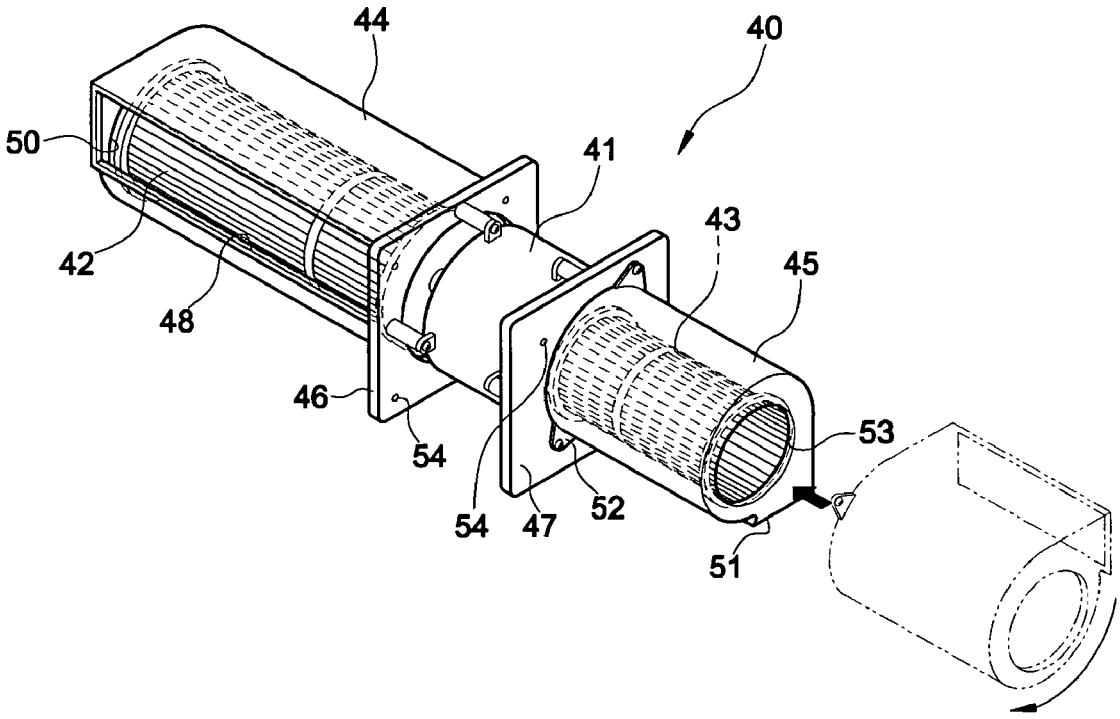

FIGS. 8 and 9 show an operation of directing the outlet 51 of the cooling fan casing 45 in the downward direction while directing the outlet 48 of the exhaust fan casing 44 forward.

To change a posture of the exhaust fan casing 44 to a position in which the outlet 48 of the exhaust fan casing 44 faces forward from a position in which the outlet 48 of the exhaust fan casing 44 faces in the upward direction (see FIG. 3), the exhaust and cooling unit 40 is first rotated counter-clockwise by an angle of 90 degrees, and the cooling fan casing 45 is removed from the second bracket 47, as shown in FIG. 8.

Subsequently, the cooling fan casing 45 rotates clockwise by an angle of 90 degrees, and is mounted on the second bracket 47 by screws, as shown in FIG. 9. As a result, the outlet 51 of the cooling fan casing 45 is directed in the downward direction while the outlet 48 of the exhaust fan casing 44 remains to be directed in a forward direction. Accordingly, the exhaust fan 42 may discharge exhaust gas in the forward direction, and the cooling fan casing 45 can direct air into the electrical component compartment 12.

As is apparent from the above description, a wall mounted type microwave oven is provided, which is constructed such that it is not necessary to modify a space which is occupied by an exhaust and cooling unit set on the microwave oven even when an orientation of a cooling fan casing is changed to change a direction of an outlet of an exhaust fan casing to any one of the upward, rearward and forward directions of an oven cabinet. Accordingly, there is no necessity to enlarge the oven cabinet or to reduce a volume of a cooking chamber in order to change an orientation of the exhaust and cooling fan.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A wall mounted type microwave oven, comprising:

an oven cabinet with an exhaust path disposed at a side of the oven cabinet;

a cooking chamber and an electrical component compartment formed in the oven cabinet and isolated from each other; and an exhaust and cooling unit disposed at an upper portion of the oven cabinet, the exhaust and cooling unit comprising:

an exhaust fan to discharge exhaust gas introduced into the exhaust path, a cooling fan to blow air into the electrical component compartment, the cooling fan having a diameter smaller than a diameter of the exhaust fan, a driving motor coupled to the exhaust fan and the cooling fan at opposite ends thereof to rotate the exhaust fan and the cooling fan, an exhaust fan casing to house the exhaust fan, a cooling fan casing to house the cooling fan, and first and second brackets disposed at the opposite ends of the driving motor to hold the exhaust fan casing and the cooling fan casing fixed thereto, wherein an axis of the cooling fan casing substantially coincides with an axis of the second bracket, and is eccentric to an axis of the cooling fan, and the cooling fan casing has a diameter smaller than a diameter of the exhaust fan casing.

2. The wall mounted type microwave oven as set forth in claim 1, wherein a length between the axis of the second bracket and a maximum radius region of the cooling fan casing is equal to or smaller than a length between the axis of the second bracket and a point on a side of the second bracket at which a line connected between the axis and the side of the second bracket is perpendicular to the side of the second bracket.

3. The wall mounted type microwave oven as set forth in claim 2, wherein the cooling fan casing comprises:

a pair of screws; and a pair of lugs, each having a screw hole, which are diagonally positioned with respect to the second bracket to be diametrically opposed to each other and fixed to the second bracket by the pair of screws, respectively.

4. The wall mounted type microwave oven as set forth in claim 3, wherein:

the cooling fan casing further comprises:

an outlet positioned to face the electrical component compartment; and the exhaust fan casing comprises:

an outlet positioned to face in an upward, rearward or forward direction with respect to the oven cabinet, depending on installation conditions of the wall mounted type microwave oven.

5. The wall mounted type microwave oven as set forth in claim 4, wherein a direction of the outlet of the cooling fan casing is changed such that the cooling fan casing rotates by 90 degrees with respect to the second bracket.

6. A wall mounted type microwave oven, comprising:

an oven cabinet with an exhaust path disposed at a side of the oven cabinet;

a cooking chamber and an electrical component compartment formed in the oven cabinet and isolated from each other; and an exhaust and cooling unit disposed at an upper portion of the oven cabinet, the exhaust and cooling unit comprising:

an exhaust fan and a cooling fan, a driving motor to rotate the exhaust fan and the cooling fan, an exhaust fan casing to house the exhaust fan and a cooling fan casing to house the cooling fan, axes of the exhaust fan casing to house the exhaust fan and the cooling fan casing being eccentric to axes of the exhaust fan and the cooling fan, respectively, and first and second brackets to hold the exhaust fan casing and the cooling fan casing fixed thereto, axes of the first and second brackets substantially coinciding with axes of the exhaust fan and the cooling fan, respectively, wherein a length between an axis of the cooling fan and a maximum radius region of the cooling fan casing is equal to or smaller than a half of a length of a side of the second bracket.

7. The wall mounted type microwave oven as set forth in claim 6, wherein diameters of the cooling fan and of the cooling fan casing are smaller than diameters of the exhaust fan and the exhaust fan casing, respectively.

8. The wall mounted type microwave oven as set forth in claim 7, wherein the exhaust fan casing comprises:

an outlet, and when a direction of the outlet is changed to another direction among an upward direction, a rearward direction and a forward direction with respect to the oven cabinet, the cooling fan casing rotates by an angle of 90 degrees with respect to the second bracket and an outer edge of the cooling fan casing is within a profile of the second bracket.

9. The wall mounted type microwave oven as set forth in claim 8, wherein the cooling fan casing comprises:

a pair of screws; and a pair of lugs, each having a screw hole, which are diagonally positioned with respect to the second bracket to be diametrically opposed to each other and fixed to the second bracket by the pair of screws, respectively.

10. A wall mounted type microwave oven including a cabinet with an exhaust path, a cooking chamber and an electrical component compartment disposed therein and separated from each other, comprising a blowing unit disposed in the cabinet, and comprising:

a first fan to exhaust gas from the exhaust path, a second fan to suck air into the electrical component compartment, the second fan having a diameter smaller than a diameter of the first fan, a driving motor coupled to and rotating the first and second fans, a first fan casing to house the first fan, a second fan casing to house the second fan, and first and second brackets to, respectively, couple the first and second fans to the driving motor, wherein the driving motor includes two rotating shafts such that the first and second fans are coaxially coupled to the two rotating shafts, respectively, and the first and second fans are aligned with centers of the first and second brackets, wherein an axis of the second fan casing substantially coincides with an axis of the second bracket, and is eccentric to an axis of the second fan, and the second fan casing has a diameter smaller than a diameter of the first fan casing.

11. A wall mounted type microwave oven including a cabinet with an exhaust path, a cooking chamber and an electrical component compartment disposed therein and separated from each other, comprising:

a fan to suck air into the electrical component compartment;

a driving motor coupled to and rotating the fan;

a bracket to hold the fan to the driving motor; and a fan casing coupled to the bracket to changeably guide the air in a specified direction, the fan casing being selectively rotatable such that when the fan casing is rotated an outer profile thereof remains within a profile of the bracket extending in a direction of an axis of the fan casing.

12. A wall mounted type microwave oven, comprising:

a cabinet with an exhaust path, a cooking chamber and an electrical component compartment disposed therein; and an exhaust and cooling unit disposed at an upper portion of the cabinet, the exhaust and cooling unit comprising:

a plurality of fans, a driving motor to rotate the plurality of fans, a plurality of brackets to hold the fans to the driving motor, and a plurality of casings to house respective ones of the plurality of fans, wherein the fan casings are coupled to corresponding brackets to changeably guide the air in a specified direction, the fan casings being selectively rotatable such that when any fan casing is selectively rotated an outer profile thereof remains within a profile of the corresponding bracket extending in a direction of an axis of the selected fan casing.

* * * * *